US010073379B2

(12) United States Patent
Sekura et al.

(10) Patent No.: US 10,073,379 B2
(45) Date of Patent: Sep. 11, 2018

(54) DEVELOPING DEVICE AND IMAGE FORMING APPARATUS

(71) Applicant: FUJI XEROX CO., LTD., Tokyo (JP)

(72) Inventors: Yuki Sekura, Ebina (JP); Toru Iwanami, Ebina (JP); Wenxiang Ge, Ebina (JP); Hideaki Ozawa, Ebina (JP); Tomonori Sato, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 1 day.

(21) Appl. No.: 15/246,557

(22) Filed: Aug. 25, 2016

(65) Prior Publication Data

US 2017/0227889 A1 Aug. 10, 2017

(30) Foreign Application Priority Data

Feb. 5, 2016 (JP) ..... 2016-020500

(51) Int. Cl.
*G03G 15/00* (2006.01)
*G03G 15/08* (2006.01)
*G03G 15/095* (2006.01)

(52) U.S. Cl.
CPC ..... *G03G 15/0887* (2013.01); *G03G 15/0824* (2013.01); *G03G 15/0889* (2013.01); *G03G 15/095* (2013.01); *G03G 2215/0607* (2013.01); *G03G 2215/0805* (2013.01); *G03G 2215/085* (2013.01); *G03G 2215/0888* (2013.01); *G03G 2221/0005* (2013.01)

(58) Field of Classification Search
CPC ..... G03G 15/0879; G03G 15/0829; G03G 15/0889; G03G 15/0887; G03G 15/0893; G03G 15/0877; G03G 15/0865
See application file for complete search history.

(56) References Cited

U.S. PATENT DOCUMENTS

2009/0317140 A1* 12/2009 Yoshida ..... G03G 15/0879 399/254
2010/0215401 A1* 8/2010 Fujiwara ..... G03G 15/09 399/119
2011/0176839 A1* 7/2011 Gonda ..... G03G 15/0887 399/263
2013/0101317 A1* 4/2013 Shimizu ..... G03G 15/0896 399/258

FOREIGN PATENT DOCUMENTS

JP 2008129422 6/2008

* cited by examiner

*Primary Examiner* — Walter L Lindsay, Jr.
*Assistant Examiner* — Jessica L Eley
(74) *Attorney, Agent, or Firm* — JCIPRNET

(57) ABSTRACT

According to an aspect of the invention, a developing device includes a developing container that accommodates a two-component developer, a toner concentration detecting unit that detects a toner concentration of the developer by a detecting unit exposed to an inner wall of the developing container, a transport member that is disposed within the developing container and stirs and transport the developer with a transport blade having a pitch that is equal to or less than a size of the detecting unit of the toner concentration detecting unit, and a plurality of gap holding members that is provided at a position facing the toner concentration detecting unit of the transport member and holds a gap such that a tip thereof is abutted against the inner wall of the developing container.

11 Claims, 11 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2016-020500 filed Feb. 5, 2016.

BACKGROUND

Technical Field

The present invention relates to a developing device and an image forming apparatus.

SUMMARY

According to an aspect of the invention, there is provided a developing device including: a developing container that accommodates a two-component developer; a toner concentration detecting unit that detects a toner concentration of the developer by a detecting unit exposed to an inner wall of the developing container; a transport member that is disposed within the developing container and stirs and transport the developer with a transport blade having a pitch that is equal to or less than a size of the detecting unit of the toner concentration detecting unit; and a plurality of gap holding members that is provided at a position facing the toner concentration detecting unit of the transport member and holds a gap such that a tip thereof is abutted against the inner wall of the developing container.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described with reference to the accompanying drawings.

[Exemplary Embodiment 1]

Figure 1:
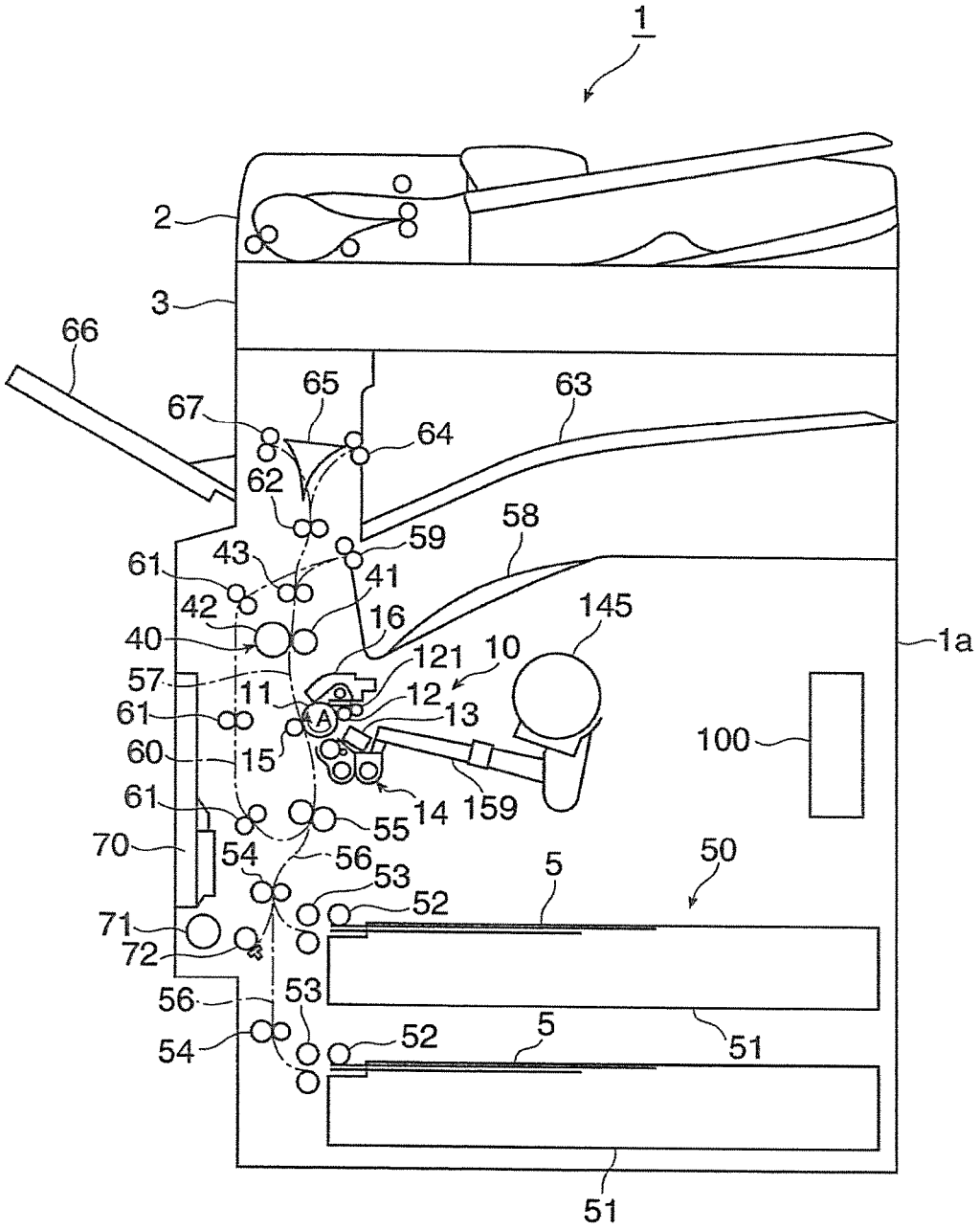
FIG. 1 is a view illustrating an overall configuration of an image forming apparatus to which a developing device according to exemplary embodiment 1 of the present invention is applied.
Figure 2:
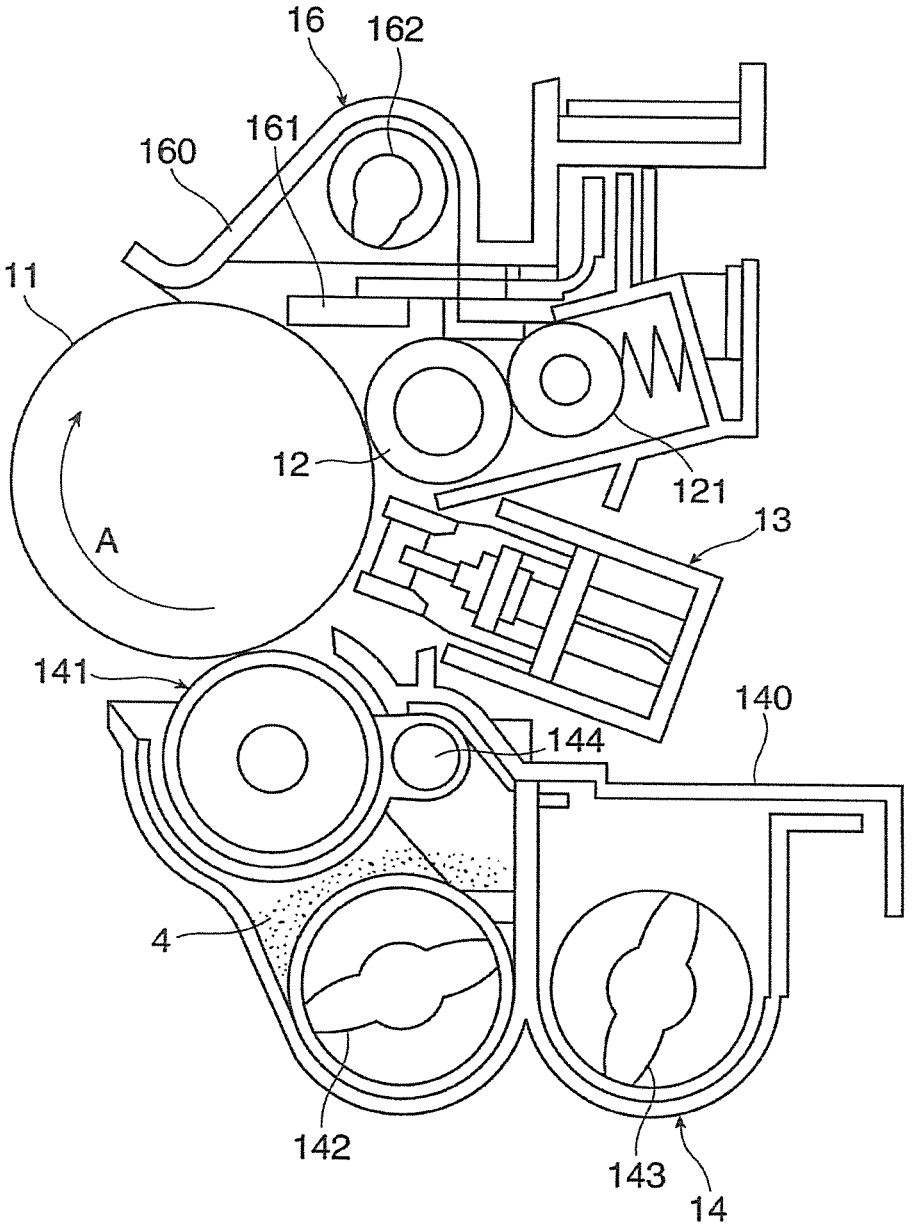
FIG. 2 is a view illustrating a configuration of an image forming section of the image forming apparatus to which the developing device according to exemplary embodiment 1 of the present invention is applied.
Figure 3:
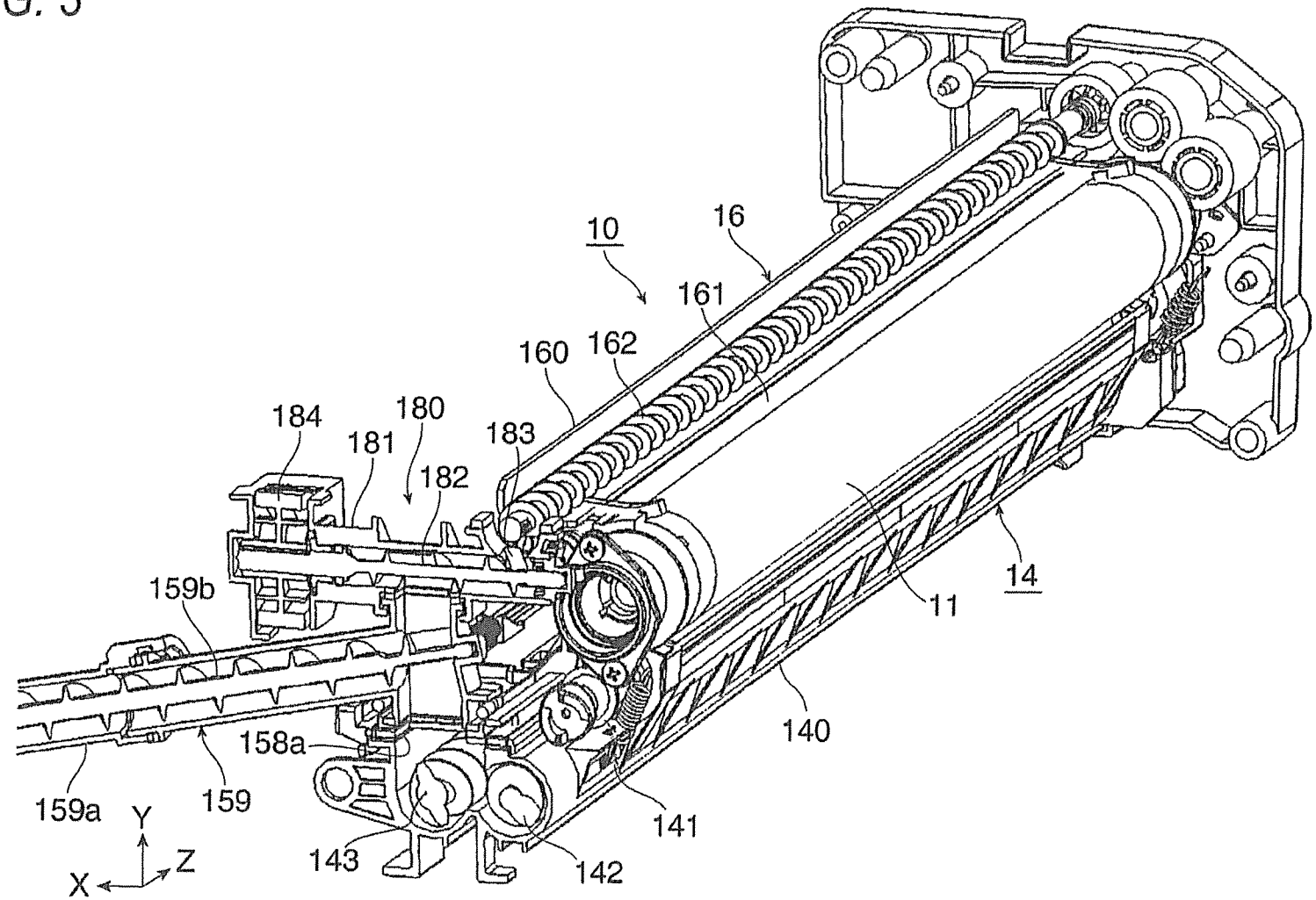
FIG. 3 is a partially broken perspective view illustrating a configuration of a main part of the image forming apparatus to which the developing device according to exemplary embodiment 1 of the present invention is applied.

FIG. 1 is a view illustrating an overall configuration of an image forming apparatus to which a developing device according to exemplary embodiment 1 of the present invention is applied. FIG. 2 is a view illustrating a configuration of an image forming section of the image forming apparatus to which the developing device according to exemplary embodiment 1 of the present invention is applied. FIG. 3 is a partially broken perspective view illustrating a configuration of a main part of the image forming apparatus to which the developing device according to exemplary embodiment 1 of the present invention is applied.

<Overall Configuration of Image Faulting Apparatus>

An image forming apparatus 1 according to exemplary embodiment 1 is configured as, for example, a monochrome copier. The image forming apparatus 1 may include, on an upper portion of an apparatus body 1*a*, an automatic document feeder 2 that feeds a document (not illustrated) in a state where the document is separated one by one, and an image reader 3 that reads an image of the document fed by the automatic document feeder 2 or a document loaded on platen glass (not illustrated). Further, the image forming apparatus 1 includes, within the apparatus body 1*a*, an imaging device 10 that forms a toner image developed by toner constituting a developer, a transfer device 15 that transfers the toner image formed by the imaging device 10 to a recording sheet 5 as an example of a recording medium, a sheet feeding device 50 that receives and feeds a required recording sheet 5 which is to be fed to a transfer location of the transfer device 15, a fixing device 40 that fixes the toner image to the recording sheet 5 transferred by the transfer device 15, and so on. Further, the apparatus body 1*a* is formed of a support structure member, an exterior cover, or the like.

As illustrated in FIG. 1, the imaging device 10 includes a rotary photoconductor drum 11 as an example of an image holding member, and the following devices are mainly arranged as an example of a toner image forming unit around the photoconductor drum 11. Main devices include a charging device 12 that charges a peripheral surface (image holding surface) on which an image of the photoconductor drum 11 may be forming, with a required potential, an exposure device 13, as an example of an electrostatic latent image forming unit, that irradiates light based on image information (signal) onto the charged peripheral surface of the photoconductor drum 11 to form the electrostatic latent image having a potential difference, a developing device 14, as an example of a developing unit, that develops the electrostatic latent image with the toner of the developer to make a toner image, a transfer device 15, as an example of a transfer unit that transfers the toner image to the recording sheet 5, and a drum cleaning device 16 that eliminates attached matter, such as, toner, from an image holding surface of the photoconductor drum 11 so as to clean the image holding surface after the transfer.

The photoconductor drum 11 forms an image holding surface having a photoconductive layer (photosensitive layer) that is made of a photosensitive material on a peripheral surface of a grounded cylindrical or columnar base. The photoconductor drum 11 is supported to be rotated in a direction illustrated by arrow A when power is transmitted thereto from a driving device (not illustrated).

The charging device 12 is configured as a contact-type charging roll placed to be in contact with the photoconductor drum 11. A charging voltage is supplied to the charging device 12. In a case where the developing device 14 is configured to perform reversal development, a voltage or current having the same polarity as the charged polarity of the toner supplied from the developing device 14 is supplied as the charging voltage. Further, a cleaning roll 121 is disposed on the charging device 12 to come into contact therewith, thereby cleaning the surface of the charging device. The charging device 12 may use a non-contact type charging device, such as, a scorotron, which is placed on the surface of the photoconductor drum 11 in a non-contact state.

The exposure device 13 irradiates light that is configured depending on image information of document read by the image reader 3 or image information input from an external personal computer to the image forming apparatus 1, onto the charged peripheral surface of the photoconductor drum 11, thus forming an electrostatic latent image. When the latent image is formed, the image information of the document read by the image reader 3 or image information (signal) input to the image forming apparatus 1 by any unit is transmitted to the exposure device 13.

The exposure device 13 is constituted with an LED print head that irradiates light corresponding to the image information to the photoconductor drum 11 by LEDs (Light Emitting Diodes) as plural light emitting elements arranged in an axial direction of the photoconductor drum 11, thus forming an electrostatic latent image. Further, an exposure device configured to perform deflection scanning of laser beams configured according to the image information in the axial direction of the photoconductor drum 11 may be used as the exposure device 13.

As illustrated in FIG. 2, the developing device 14 includes, within a device housing 140 as an example of a developing container in which an opening and an accommodation chamber of the developer 4 are formed, a developing roll 141 as an example of a developer holding member which holds the developer 4 and transports the developer 4 to a developing area facing the photoconductor drum 11, a supply and transport member 142, such as a screw auger, which supplies the developer to the developing roll 141 while stirring the developer 4, an stirring and transport member 143, such as a screw auger, which stirs and transports the developer while delivering the developer 4 between the stirring and transport member and the supply and transport member 142, and a layer thickness regulating member 144 that regulates an amount (layer thickness) of the developer held by the developing roll 141. A two-component developer containing a non-magnetic toner and a magnetic carrier is used as the developer 4. Further, the developing device 14 will be described below in detail.

The transfer device 15 is a contact-type transfer device provided with a transfer roll, which rotates and comes into contact with a periphery of the photoconductor drum 11 and is supplied with a transfer voltage. As the transfer voltage, a DC voltage exhibiting a polarity that is reverse to the charged polarity of the toner is supplied from a power source device (not illustrated).

As illustrated in FIGS. 2 and 3, the drum cleaning device 16 includes a container-type body 160 of which the lower end surface is partially opened, a cleaning plate 161 disposed to come into contact with the peripheral surface of the photoconductor drum 11 after the transfer with required pressure to remove the attached matter of the residual toner or the like so as to clean the peripheral surface of the photoconductor drum 11, a sending member 162, such as, for example, a screw auger, that recovers and transports the attached matter such as the toner removed by the cleaning plate 161 to send the attached matter to the developing device 14 or a recovery system (not illustrated). In this exemplary embodiment, the attached matter including the toner removed by the cleaning plate 161 is recovered and sent through a reuse device 180 to be described later to the developing device 14. As the cleaning plate 161, a plate-shaped member (e.g., a cleaning blade) made of a material such as, for example, rubber is used.

The fixing device 40 is configured by arranging a belt-type or roll-type heating rotary body 41 heated by a heating unit such that a surface temperature is kept at a required temperature, a roll-type or belt-type pressurizing rotary body 42 configured to be rotated by coming in contact with the heating rotary body 41 in a state of substantially following the axial direction of the heating rotary body 41 with a predetermined pressure, and so on. The fixing device 40 includes a fixing treatment section configured to perform required fixing treatments (heating and pressurizing) by a contact portion that is in contact with the heating rotary body 41 and the pressurizing rotary body 42.

The sheet feeding device 50 is placed at a position below the imaging device 10. The sheet feeding device 50 mainly includes a singular (plural) sheet storage body (bodies) 51 that receive(s) recording sheets 5 of a desired size and kind in a stacked state, and sending devices 52 and 53 that send the recording sheets 5 from the sheet storage body 51 one by one. For example, the sheet storage body 51 is attached to be withdrawn to the front side (the side where a user faces during the operation) of the apparatus body 1*a*.

As the recording sheets 5, a thin paper (e.g., a plain paper, an OHP sheet, or a tracing paper), which is used in an electrophotographic copier, a printer, or the like may be exemplified. In order to further improve the smoothness of an image surface after the fixing, it is preferable that the surfaces of the recording sheets 5 are as smooth as possible, and a so-called thick paper or the like that has a relatively heavy basis weight (e.g., a coated paper obtained by coating a surface of the plain paper with a resin or the like, a printing art paper).

Between the sheet feeding device 50 and the transfer device 15, a sheet feeding transport path 56 is provided which includes a singular (or plural) sheet transport roll pair(s) 54 and 55 or a transport guide (not illustrated) to transport the recording sheets 5 sent from the sheet feeding device 50 to a transfer location. The sheet transport roll pair 55 includes, for example, a roll (registration roll) that regulates a transport time of the recording sheets 5. Further, a sheet transport path 57 is provided between the transfer device 15 and the fixing device 40 so as to transport the recording sheets 5 sent from the transfer device 15 after the transfer to the fixing device 40. In addition, a sheet exit roll pair 59 is arranged in a portion near an exit port of the recording sheet 5 formed in the apparatus body 1*a* so as to discharge the recording sheets 5, which are sent from an outlet roll 43 of the fixing device 40 after the fixing, to a sheet discharge portion 58 installed in an upper portion of the apparatus body 1*a*.

A switching gate (not illustrated) is provided between the fixing device 40 and the sheet exit roll pair 59 to switch sheet transport paths. The sheet exit roll pair 59 is configured to switch its rotating direction between a forward rotation direction (discharge direction) and a reverse rotation direction. In the case of forming an image on both sides of the recording sheet 5, the rear end of the recording sheet 5, which is formed with an image on one side thereof, passes through the switching gate (not illustrated), and then the rotating direction of the sheet exit roll pair 59 is switched from the forward rotation direction (discharge direction) to the reverse rotation direction. The recording sheet 5 transported by the sheet exit roll pair 59 in the reverse direction is subjected to the switching of the transport path thereof by the switching gate (not illustrated), and is transported to a duplex transport path 60 that is formed along a side of the apparatus body 1*a* in a substantially vertical direction. The duplex transport path 60 includes plural sheet transport roll pairs 61 configured to transport the recording sheets 5 to the sheet transport roll pair 55 in the state where the a front and a back of the sheet are reversed, a transport guide (not illustrated), and so on.

Further, above the fixing device 40, a sheet exit roll pair 64 and a sheet exit roll pair 67 are provided, in which the sheet exit roll pair 64 discharges, through the sheet transport roll pair 62, the recording sheets 5, which are sent from the exit roll 43 of the fixing device 40 after the fixing, to the second sheet discharge portion 63 installed at the upper portion of the apparatus body 1*a* for face-down discharge, and the sheet exit roll pair 67 switches the transport direction by the switching gate 65 to discharge the recording sheet 5 after the fixing to the third sheet discharge portion 66 installed at a side of the upper portion of the apparatus body 1*a* for face-up discharge.

In FIG. 1, reference numeral 70 denotes a manual feed tray that is provided on the left side of the apparatus body 1*a* of the image forming apparatus 1 to be opened or closed. A sending device 71 and a separation roll 72 are disposed between the manual feed tray 70 and the sheet transport roll pair 54. The sending device 71 sends the recording sheets 5 accumulated by the manual feed tray 70 one by one, and the separation roll 72 separating the recording sheets 5 sent by the sending device 71 one by one.

Further, reference numeral 145 of FIG. 1 denotes a toner cartridge that is arranged in a direction perpendicular to the paper face and accommodates the developer containing at least toner supplied to the developing device 14.

In addition, reference numeral 100 of FIG. 1 illustrates a controller that generally controls an operation of the image forming apparatus 1. The controller 100 includes a CPU (Central Processing Unit), a ROM (Read Only Memory), and a RAM (Random Access Memory), which are not illustrated, or a bus, a communication interface, or the like that connects the CPU, the ROM, or the like.

As illustrated in FIG. 3, the image forming apparatus 1 of the exemplary embodiment includes a reuse device 180 as an example of a reuse unit that transports the attached matter, such as the toner that is removed by the cleaning plate 161 of the drum cleaning device 16 and transported, to one end of the photoconductor drum 11 in an axial direction thereof, by the sending member 162 such as the screw auger, to the developing device 14, so as to reuse the attached matter for development. The reuse device 180 includes a cylindrical transport path forming member 181, and a screw auger 182 rotatably placed in the transport path forming member 181 to transport the attached matter, such as the recovered toner, and drop the attached matter to a supply port 158*a* of the developing device 14. Further, a miler film 183 is attached to one axial end of the screw auger 182 to scrape out the toner or the like transported by the sending member 162 of the cleaning device 16 and drop the toner or the like into the transport path forming member 181. A gear 184 configured to rotatably drive the screw auger 182 is provided on the other axial end of the screw auger 182.

<Operation of Image Forming Apparatus>

Hereinafter, a basic image forming operation by the image forming apparatus 1 will be described.

When the image forming apparatus 1 receives instruction information that requests an image forming operation (print), the imaging device 10, the transfer device 15, the fixing device 40, and so on are started. In the image forming operation, if necessary, an image (not illustrated) of a document fed by the automatic document feeder 2 or an image (not illustrated) of a document positioned on platen glass is read by an image reader 3.

In addition, in the imaging device 10, first, the photoconductor drum 11 is rotated in a direction indicated by arrow A so that the charging device 12 charges the surface of the photoconductor drum 11 with a required polarity (negative polarity in exemplary embodiment 1) and potential. Subsequently, the exposure device 13 converts image information of document read by the image reader 3 or image information input to the image forming apparatus 1 into black and white components, and irradiates emitted light based on the signal of the image obtained by the conversion to the charged surface of the photoconductor drum 11, thereby forming, on the surface, an electrostatic latent image that is configured by a required potential difference.

Subsequently, the developing device 14 supplies toner charged with the required polarity (negative polarity) from the developing roll 141 to the electrostatic latent image formed on the photoconductor drum 11 to electrostatically attach the toner to the electrostatic latent image, thereby performing the development. By the development, the electrostatic latent image formed on the photoconductor drum 11 is developed as a monochrome toner image that is developed by black toner.

Subsequently, when the toner image formed on the photoconductor drum 11 of the imaging device 10 is transported to the transfer location, the transfer device 15 transfers the toner image to the recording sheet 5.

Further, in the imaging device 10 where the transfer has been completed, the drum cleaning device 16 scrapes out and remove the attached matter, such as the toner to clean the surface of the photoconductor drum 11. Thus, the imaging device 10 is ready to form a next image. The toner or the like scraped by the drum cleaning device 16 is transported to the developing device 14 by the reuse device 180, and used for development again.

Meanwhile, the sheet feeding device 50 sends the required recording sheets 5 to the sheet feeding transport path 56, according to the image forming operation. In the sheet feeding transport path 56, the sheet transport roll pair 55 as the registration roll sends and supplies the recording sheets 5 to the transfer location according to a transfer time.

Subsequently, the recording sheets 5 to which a toner image is transferred from the photoconductor drum 11 are transported to the fixing device 40 through the transport guide (not illustrated). The fixing device 40 performs a required fixing treatment (heating and pressurizing) by introducing the transferred recording sheets 5 into the contact portion between the rotating heating rotary body 41 and the pressurizing rotary body 42, thereby fixing an unfixed toner image to the recording sheets 5. Finally, after the fixation is terminated, the recording sheets 5 are discharged to the sheet discharge portion 58 or the like installed in the upper portion of the apparatus body 1*a* by the sheet exit roll pair 59 or the like, in the case of an image forming operation of forming an image on one side.

Further, when an image is formed on both sides of a recording sheet 5, while the rear end of the recording sheet 5, which is formed with an image on one side thereof, is maintained by the sheet exit roll pair 59 without being discharged by the sheet exit roll pair 59, the rotating direction of the sheet exit roll pair 59 is switched to the reverse rotation direction. The recording sheet 5 transported in the reverse rotation direction by the sheet exit roll pair 59 passes through the switching gate (not illustrated), and then is transported again to the sheet transport roll pair 55 in the state where the a front and a back of the sheet are reversed, through the duplex transport path 60 that is provided with the sheet transport roll pair 61, the transport guide (not illustrated), or the like. The sheet transport roll pair 55 sends and supplies the recording sheet 5 to the transfer location according to a transfer time, an image is formed on the back of the recording sheet 5, and the sheet 5 is discharged to the sheet discharge portion 58 installed in the upper portion of the apparatus body 1*a* or the like by the sheet exit roll pair 59 or the like.

By the above-described operation, the recording sheet 5 formed with a monochrome image is output.

<Configuration of Developing Device>

Figure 4:
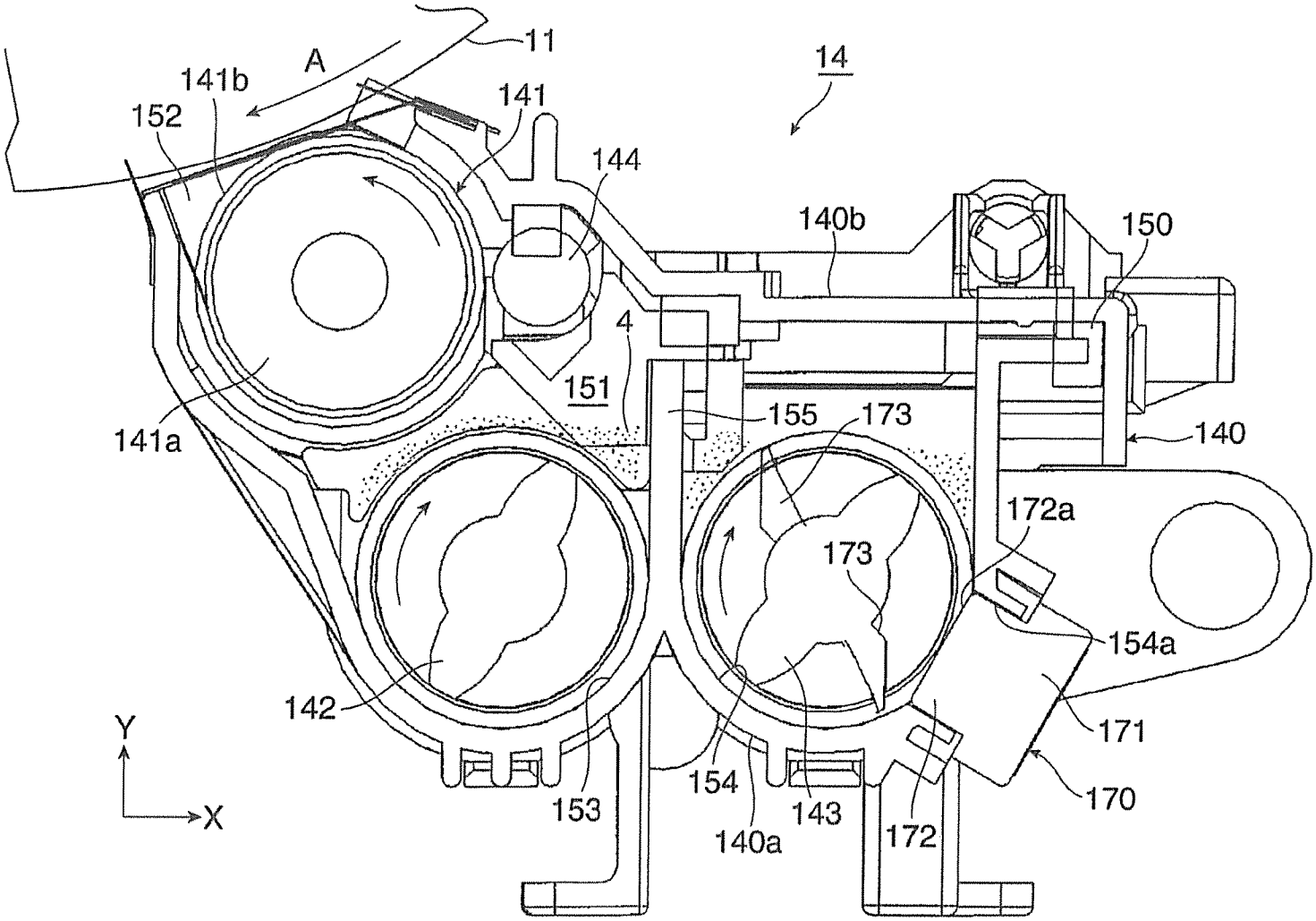
FIG. 4 is a sectional view illustrating a configuration of the developing device according to exemplary embodiment 1 of the present invention.

FIG. 4 is a sectional view illustrating a configuration of the developing device according to exemplary embodiment 1 of the present invention.

The developing device 14 includes a device housing 140 as an example of the developing container. The device housing 140 is generally constituted with a lower housing 140*a* disposed in a lower portion of the developing device 14 and an upper housing 140*b* disposed in an upper portion of the developing device 14. The lower housing 140*a* and the upper housing 140*b* are joined via a spacer member 150. A developer accommodation chamber 151 formed within the device housing 140 to accommodate the two-component developer 4 consisting of a non-magnetic toner and a magnetic carrier. An opening 152 is formed in an area of the device housing 140 which faces the photoconductor drum 11. As an example of the developer holding member, the developing roll 141 is placed within the device housing 140 to be rotatable in a direction indicated by an arrow such that the developing roll is partially exposed to the opening 152. The developing roll 141 includes a magnet roll 141*a* that is fixedly disposed therein and has plural magnetic poles of required polarities arranged at required positions in a peripheral direction thereof, and a developing sleeve 141*b* that is disposed on an outer circumference of the magnet roll 141*a* to be rotatable in a direction indicated by an arrow at a required rotating speed. The developing sleeve 141*b* is formed from a non-magnetic material (e.g., aluminum or non-magnetic stainless steel) in a cylindrical shape.

In this exemplary embodiment, the rotating direction of the developing sleeve 141*b* is set in a direction opposite to the rotating direction of the photoconductor drum 11. That is, as illustrated in FIG. 4, the rotating direction of the photoconductor drum 11 is set to a clockwise direction, while the rotating direction of the developing sleeve 141*b* is set to a counterclockwise direction. Consequently, the outer circumferential surface of the developing sleeve 141*b* is moved in the same direction as the moving direction of the surface of the photoconductor drum 11 in the developing area facing the photoconductor drum 11. Further, the rotating direction of the developing sleeve 141*b* may be set to the same direction as the rotating direction of the photoconductor drum 11. In this case, the outer circumferential surface of the developing sleeve 141*b* is moved in a direction opposite to the moving direction of the surface of the photoconductor drum 11 in the developing area facing the photoconductor drum 11.

Within the device housing 140, a supply and transport member 142, which includes, for example, a screw auger (supply auger) configured to draw up the developer 4 accommodated in the developer accommodation chamber 151 and supply the developer 4 to the developing roll 141, is disposed obliquely downward from the developing roll 141. The supply and transport member 142 is rotationally driven in the clockwise direction by a driving device (not illustrated). On a side of the developing roll 141 a columnar layer thickness regulating member 144 is disposed to regulate an amount (layer thickness) of the developer held on the developing roll 141. Further, within the device housing 140, a stirring and transport member 143, which includes, for example, a screw auger (admix auger) configured to stir and transport the developer 4 supplied into the device housing 140, is disposed on the rear side of the supply and transport member 142. The stirring and transport member 143 is also rotationally driven in the clockwise direction by the driving device (not illustrated).

Figure 5:
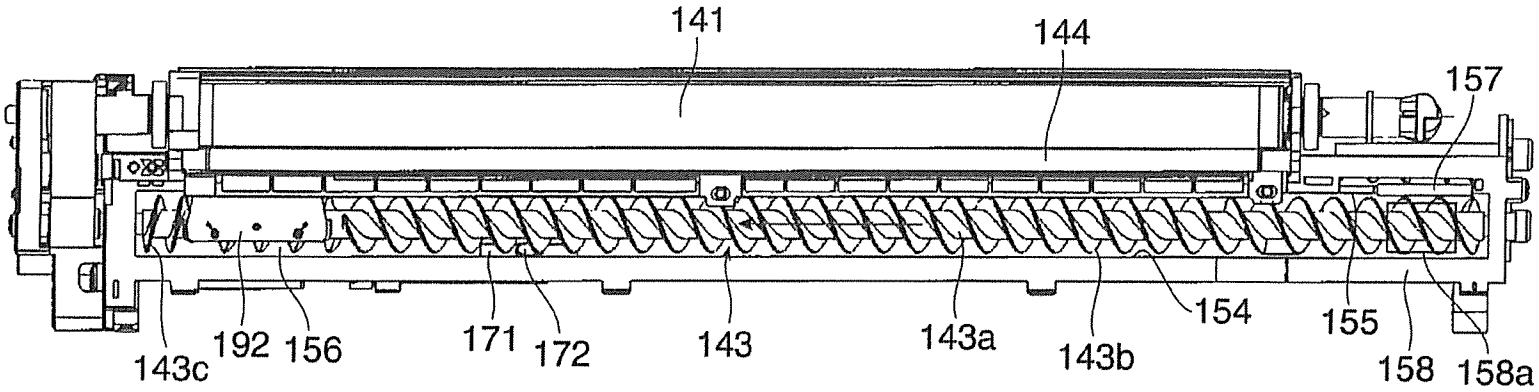
FIG. 5 is a plan view illustrating a configuration of the developing device according to exemplary embodiment 1 of the present invention in a state in which an upper housing is removed.

FIG. 5 is a plan view illustrating a configuration of the developing device in the state in which the upper housing is removed.

The supply and transport member 142 and the stirring and transport member 143 are configured to be similar to each other. Here, the configuration of the stirring and transport member 143 will be representatively described. As illustrated in FIG. 5, the stirring and transport member 143 includes a columnar rotating shaft 143*a* and a transport blade 143*b* that is integrally provided on an outer circumference of the rotating shaft 143*a* in a spiral form. The stirring and transport member 143 is integrally formed by, for example, an injection molded synthetic resin. The stirring and transport member 143 is provided with a reverse feed transport blade 143*c* on the downstream side end thereof in the transport direction of the developer 4 at a short length ranging from 2 to 3 pitches to return the developer 4 transported by the stirring and transport member 143 to the upstream side in the transport direction.

In this exemplary embodiment, in order to enhance the productivity that is determined by the number of the recording sheets 5 on which an image may be formed per unit time in the image forming apparatus 1, the photoconductor drum 11, and the developing roll 141, the supply and transport member 142, and the stirring and transport member 143 of the developing device 14 are configured to relatively increase a rotating speed to achieve a high rotating speed.

Figure 9:
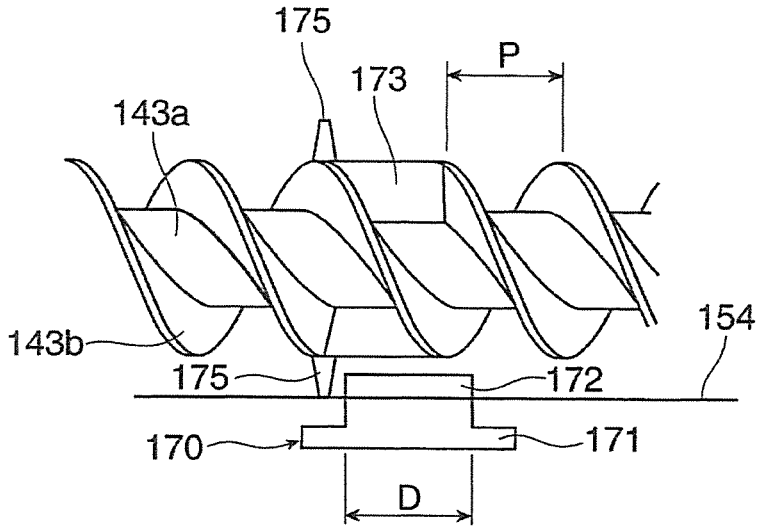
FIG. 9 is a configuration diagram illustrating a stirring and transport member.

More specifically, the pitch P of the transport blade 143*b* of the supply and transport member 142 or the stirring and transport member 143 is set to be relatively small such that the developer 4 may be stably transported in the axial direction even in the case where the supply and transport member 142 and the stirring and transport member 143 arrives at the high rotating speed. As will be described later, the pitch P of the transport blade 143*b* of the supply and transport member 142 and the stirring and transport member 143 is set to be equal to or less than a diameter D of a detecting unit 172 of the toner concentration sensor 170. In this exemplary embodiment, as illustrated in FIG. 9, the pitch P of the transport blade 143*b* of the supply and transport member 142 and the stirring and transport member 143 is set to be smaller than the diameter D of the detecting unit 172 of the toner concentration sensor 170.

As illustrated in FIG. 4, the lower housing 140*a* is provided with a first accommodating section 153 and a second accommodating section 154 each having a substantially semi-cylindrical shape, in order to accommodate the supply and transport member 142 and the stirring and transport member 143. The first accommodating section 153 and the second accommodating section 154 are partitioned by a partition wall 155 installed in the lower housing 140*a*.

As illustrated in FIG. 5, the supply and transport member 142 and the stirring and transport member 143 are set to be longer than the developing roll 141 in the axial length. Each of the supply and transport member 142 and the stirring and transport member 143 is rotatably supported at both ends thereof by the lower housing 140*a*. A supply portion 158 formed in a rectangular shape in the device housing 140 is provided to protrude from one axial end of the stirring and transport member 143. A supply port 158*a* is opened in the supply portion 158 to cause the developer 4 transported from the toner cartridge 145 by the transport member 159 to be dropped to the inside of the device housing 140. As illustrated in FIG. 3, the transport member 159 includes a cylindrical transport path forming member 159*a* and a screw auger 159*b* rotatably disposed within the transport path forming member 159*a* to transport the developer 4.

Figure 6:
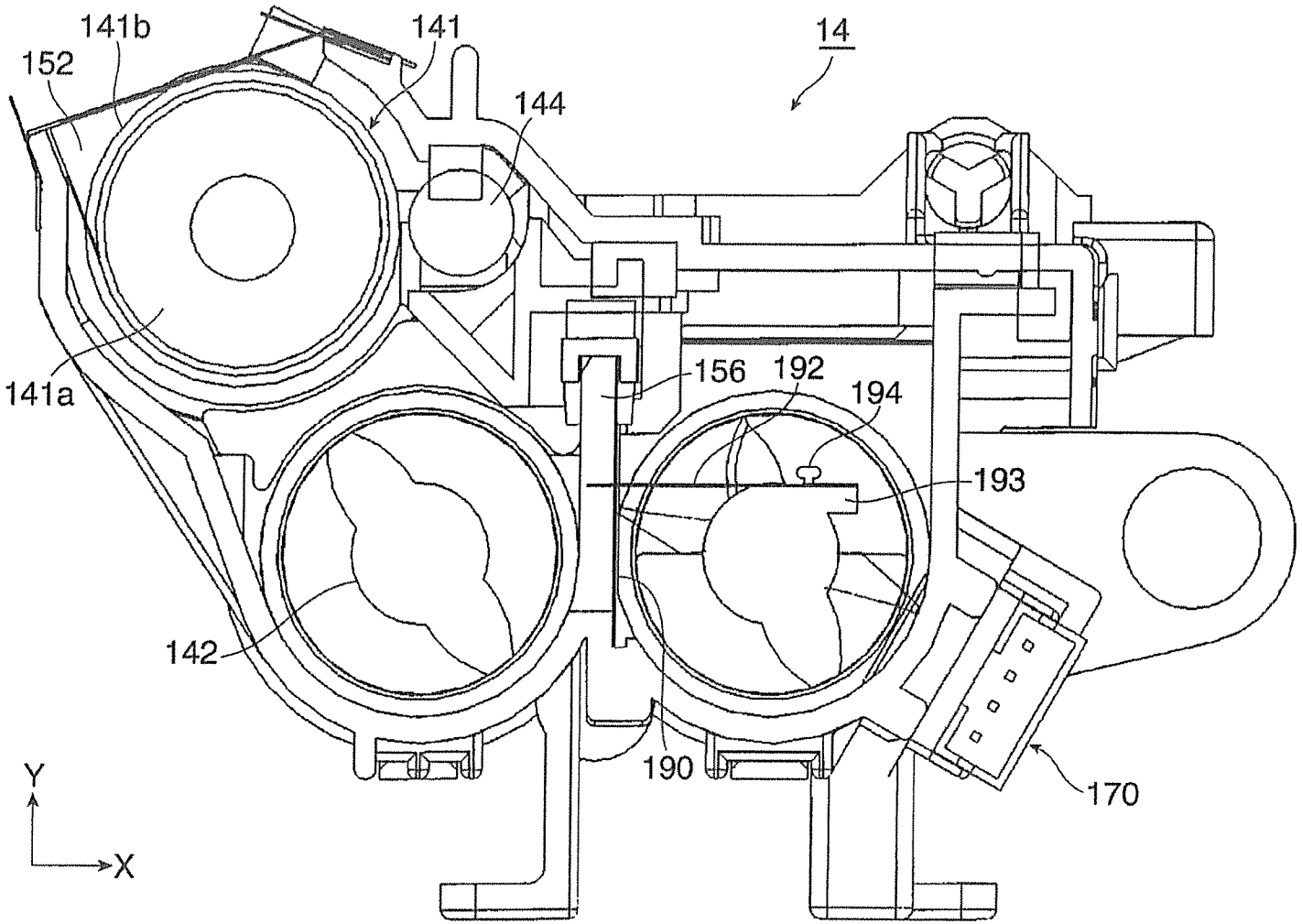
FIG. 6 is a sectional view illustrating a configuration of the developing device according to exemplary embodiment 1 of the present invention.

As illustrated in FIGS. 5 and 6, the partition wall 155 partitioning the supply and transport member 142 from the stirring and transport member 143 includes first and second passage portions 156 and 157 which are respectively provided on both ends thereof in the longitudinal direction so as to perform the exchange of the developer 4 between the supply and transport member 142 and the stirring and transport member 143. As illustrated in FIG. 6, the developer 4 transported by the stirring and transport member 143 to an end in the axial direction is transported to the supply and transport member 142 through the first passage portion 156, and supplied to the developing roll 141 while being stirred and transported by the supply and transport member 142. Further, the developer 4 transported by the supply and transport member 142 to the end in the axial direction is transported to the stirring and transport member 143 through the second passage portion 157, thereby being circulated.

Further, while the toner supplied into the device housing 140 from the supply port 158*a* is transported by the stirring and transport member 143, the toner is stirred with the developer 4 accommodated in the device housing 140.

However, in this exemplary embodiment, as described above, the attached matter such as the toner removed by the drum cleaning device 16 is transported to the developing device 14 by the reuse device 180, and is used again for developing in the developing device 14. In this regard, the attached matter removed by the drum cleaning device 16 includes foreign matter, such as fiber or paper debris, of the recording sheet 5 attached to the surface of the photoconductor drum 11 in the transfer location of the photoconductor drum 11, in addition to the transfer residual toner remaining on the surface of the photoconductor drum 11. When the foreign matter circulates in the developing device 14 and is transported by the developing roll 141 to the developing area with the developer 4, the toner may not be developed only in an area where the foreign matter exits on the surface of the developing roll 141, and as a result an image defect such as a white spot may occur.

Figure 7:
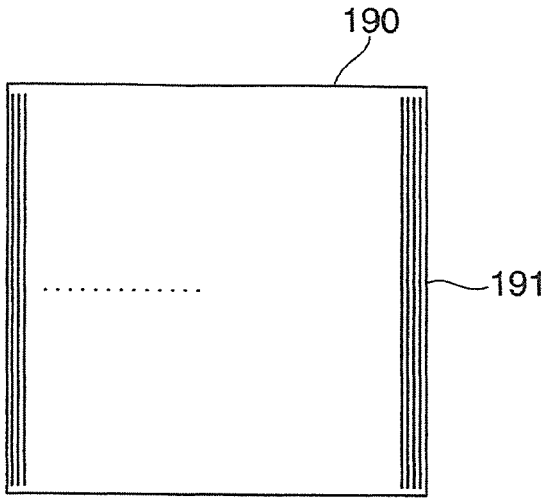
FIG. 7 is a schematic view illustrating a foreign matter capturing screen member.
Figure 8:
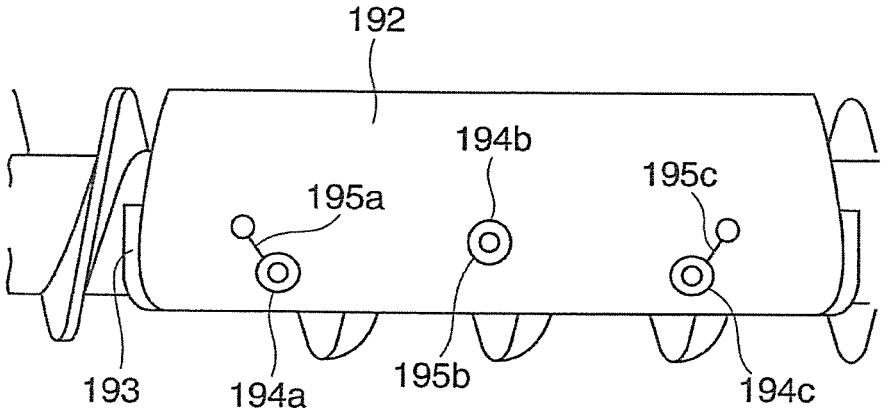
FIG. 8 is a plan view illustrating a cleaning member.

Therefore, in this exemplary embodiment, as illustrated in FIG. 6, a foreign matter removing screen member 190 is installed to block a first passage portion 156. As illustrated in FIG. 7, the foreign matter removing screen member 190 is made of a metallic thin plate having plural slits 191 that are formed by an etching process or the like and have a gap (about 0.1 mm) set to be smaller than the foreign matter entrained into the developer 4. Further, a cleaning member 192 is attached to the stirring and transport member 143 to clean foreign matter that may not pass through the foreign matter removing screen member 190. The cleaning member 192 is formed of a resin film made of PET (e.g., Mylar film) having a required thickness. Further, as illustrated in FIGS. 6 and 8, the cleaning member 192 is attached by pressing the cleaning member 192 to plural protrusions 194*a*, 194*b* and 194*c* formed on a flat plate-shaped attachment portion 193 provided on the stirring and transport member 143 through a positioning hole 195*b* and attachment slits 195*a* and 195*c* formed in the cleaning member 192.

The cleaning member 192 rubs the developer 4 against the foreign matter removing screen member 190 according to the rotation of the stirring and transport member 143, thereby causing the developer 4 to pass through the first passage 156 such that only the developer 4, which passes through the plural slits 191 of the foreign matter removing screen member 190, is filtered. The foreign matter such as fiber or paper debris of the recording sheet 5 entrained in the developer 4 or the agglomerated developer 4 is not able to pass through the foreign matter removing screen member 190, thereby being captured by the foreign matter removing screen member 190. The foreign matter captured by the foreign matter removing screen member 190 is scraped up to the upper portion of the developer 4 according to the rotation of the cleaning member 192, and stays in the upper portion of the layer of the developer 4 because the specific gravity of the foreign matter is smaller than that of the developer 4. Further, in the foreign matter, the foreign matter having a small particle diameter (e.g., paper debris of the recording sheets 5) may pass through the foreign matter removing screen member 190. However, because the specific gravity of the foreign matter such as paper debris or the like of the recording sheets 5 is considerably smaller than that of the developer 4, the foreign matter is scraped up to the upper portion of the foreign matter removing screen member 190 by the cleaning member 192, and is suppressed from passing through the foreign matter removing screen member 190.

As illustrated in FIG. 4, a toner concentration sensor 170 is provided in the device housing 140 as an example of a toner concentration detecting unit that detects the toner concentration of the developer 4 accommodated in the device housing 140. The toner concentration sensor 170 has a sensor body 171 formed in a thin, long and flat rectangular parallelepiped shape and a detecting unit 172 protruding from a side surface of the sensor body 171 in a cylindrical shape.

As illustrated in FIG. 5, the toner concentration sensor 170 is disposed in the second accommodating section 154 at a position near the downstream side end of the stirring and transport member 143 in the transport direction of the developer 4 and adjacent to the upstream side of the first passage 156. The toner concentration sensor 170 detects the toner concentration of the developer 4 by detecting the permeability of the developer 4 that is formed of a non-magnetic toner and a magnetic carrier. As illustrated in FIG. 4, the detecting unit 172 of the toner concentration sensor 170 is attached such that an end face 172*a* of the detecting unit 172 is exposed in the inner wall of the second accommodating section 154 through the opening 154*a* provided in the outer wall of the second accommodating section 154 of the lower housing 140*a*.

In addition, the stirring and transport member 143 is integrally provided with flat plate-shaped stirring members 173 configured to stir the developer 4 is integrally installed at a position corresponding to the detecting unit 172 of the toner concentration sensor 170. As illustrated in FIG. 9, the stirring members 173 are constituted with flat plate portions each integrally installed between adjacent transport blades 143*b* in the axial direction of the stirring and transport member 143 to be in parallel to each other in the axial direction of the stirring and transport member 143. The stirring members 173 stir the developer 4 positioned in front of the detecting unit 172 of the toner concentration sensor 170, thereby preventing or suppressing the developer 4 from being attached (stuck) to the detecting unit 172 of the toner concentration sensor 170, and thus preventing or suppressing an erroneous detection from being caused.

Figure 11:
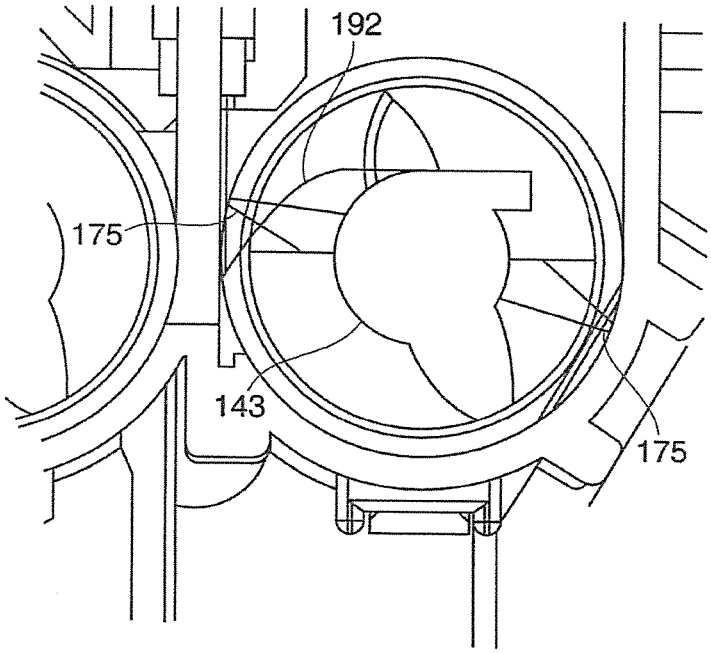
FIG. 11 is a sectional view illustrating a configuration of a main part of the developing device according to exemplary embodiment 1 of the present invention.

In the developing device 14 configured as described above, as illustrated in FIG. 6, the foreign matter removing screen member 190 configured to capture the foreign matter such as the fiber or the paper debris of the recording sheet 5 entrained in the developer 4 is installed in the first passage portion 156, and in the stirring and transport member 143, the cleaning member 192 is installed to clean the foreign matter removing screen member 190. Therefore, as illustrated in FIG. 11, when the cleaning member 192 comes into contact with the surface of the foreign matter removing screen member 190 and cleans the surface in a bent state, the stirring and transport member 143 may receive reaction accompanying the elastic deformation of the cleaning member 192 such that bending may occur.

When the stirring and transport member 143 is bent, it is difficult to maintain a gap between the toner concentration sensor 170 and the stirring member 173 of the stirring and transport member 143 at a required value, and as the stirring and transport member 143 rotates, the gap between the toner concentration sensor 170 and the stirring member 173 of the stirring and transport member 143 fluctuates.

Figure 12:
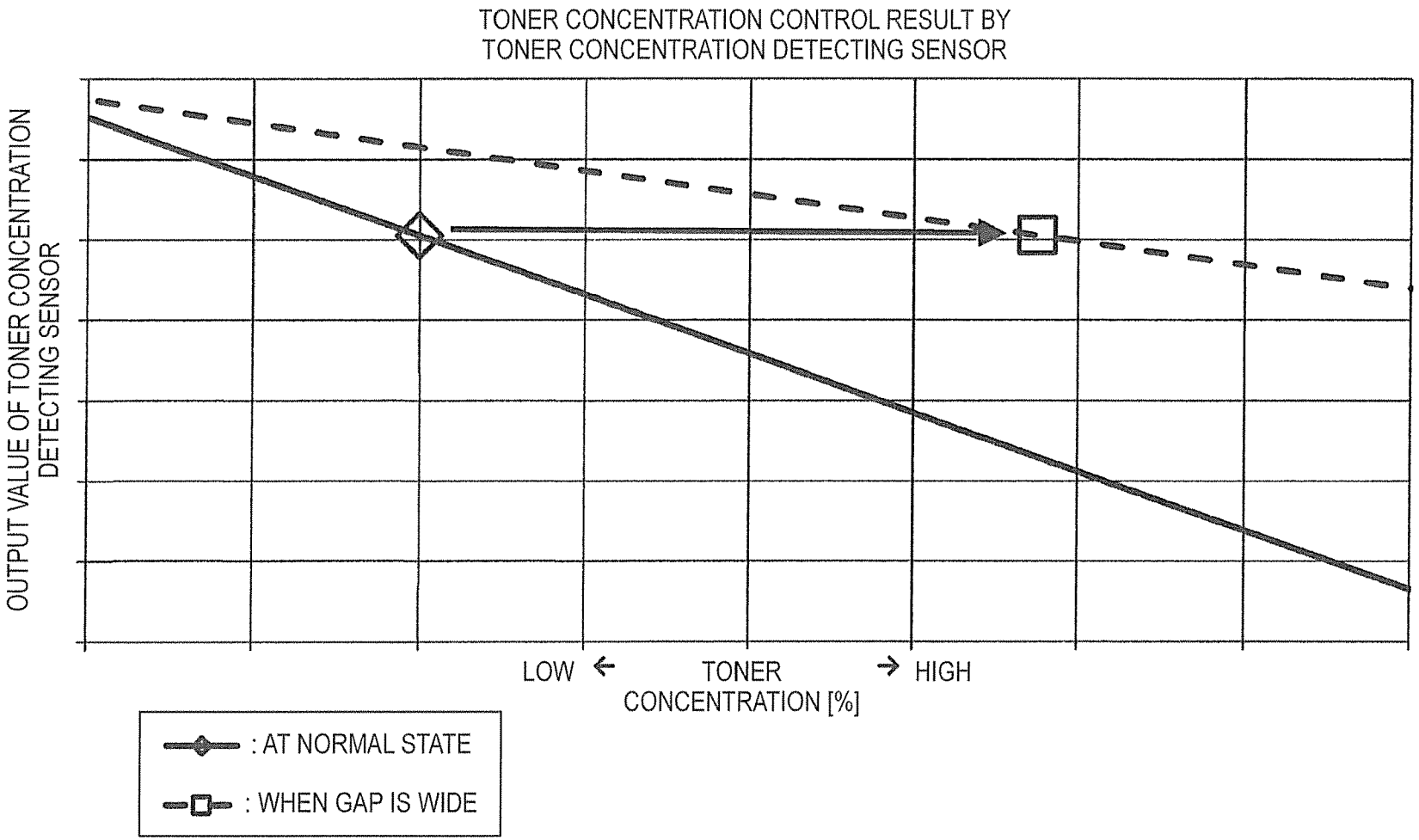
FIG. 12 is a graph illustrating a relationship between a toner concentration and an output of a toner concentration sensor.

FIG. 12 is a graph illustrating variations in output of the toner concentration sensor 170 when the toner concentration of the developer 4 accommodated in the device housing 140 of the developing device 14 is changed in a case where the gap between the toner concentration sensor 170 and the stirring member 173 of the stirring and transport member 143 has a normal value and a case where the gap is larger (wider) than the normal value. Incidentally, the output of the toner concentration sensor 170 becomes a small (low) value as the toner concentration of the developer 4 is high.

As is evident from FIG. 12, when the gap between the toner concentration sensor 170 and the stirring member 173 of the stirring and transport member 143 is in a normal value, the output value of the toner concentration sensor 170 is generally low and the gradient thereof is also large. As is evident, when the gap between the toner concentration sensor 170 and the stirring member 173 of the stirring and transport member 143 is wider than the normal value, the output value of the toner concentration sensor 170 is generally high and the gradient is also small.

Therefore, in a case where the gap between the toner concentration sensor 170 and the stirring member 173 of the stirring and transport member 143 is wider than the normal value, when the toner concentration within the developing device 14 is controlled based on the output value of the toner concentration sensor 170, the toner concentration detected by the toner concentration sensor 170 is detected to be relatively lower than an original value (in the case where the gap is normal), and a rise in toner concentration resulting from the supply of the toner is also detected to be lower than an actual gradient. Consequently, the developer may be supplied to the inside of the developing device 14 an excessive amount than the actual toner concentration so that the blow-out of the toner from the developing device 14 may occur under certain circumstances.

Therefore, this exemplary embodiment is provided with plural (two) gap holding members 175 that are installed at a position facing the toner concentration sensor 170 of the stirring and transport member 143 and abutted against the inner wall of the device housing 140 of the developing device 14 at the tips thereof so as to hold the gap between the toner concentration sensor 170 and the stirring members 173 of the stirring and transport member 143 at a required value.

Figure 10:
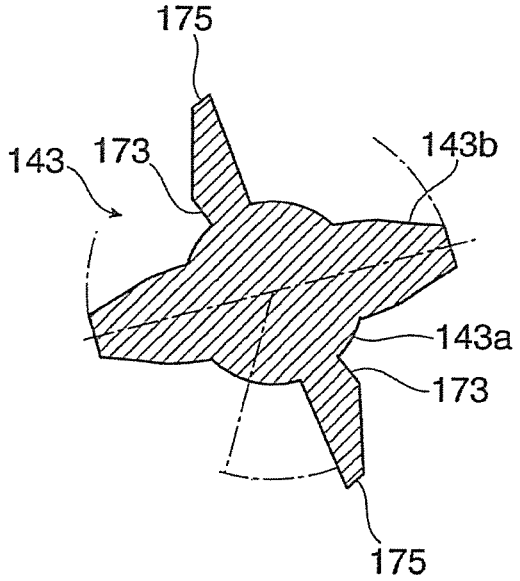
FIG. 10 is a sectional view illustrating the stirring and transport member.

As illustrated in FIGS. 9 and 10, the gap holding members 175 are integrally installed on the stirring member 173. In other words, the stirring member 173 includes the gap holding members 175 which are installed at positions different by 180 degrees on an one axial end of the stirring and transport member 143, respectively, in which each of the gap holding members 175 is formed in a prism shape that is tapered outwardly in the radial direction of the stirring and transport member 143. Further, the gap holding members 175 are disposed to be in contact with the inner wall of the second accommodating section 154 located in the vicinity of the detecting unit 172 of the toner concentration sensor 170. Further, as illustrated in FIG. 6, the gap holding members 175 are installed in the same direction as, and in the opposite direction to, the cleaning member 192 in the circumferential direction of the stirring and transport member 143, respectively.

<Operation of Characteristic Part of Developing Device>

As illustrated in FIG. 2, the developing device 14 according to exemplary embodiment 1 supplies a toner charged with the required polarity (negative polarity) from the developing roll 141 to an electrostatic latent image formed on the circumferential surface of the photoconductor drum 11 to be electrostatically attached to the electrostatic latent image, thereby developing the electrostatic latent image. By this developing, the electrostatic latent image formed on the circumferential surface of the photoconductor drum 11 is developed as a monochrome toner image that is developed with black toner.

At that time, the developer 4 accommodated in the device housing 140 of the developing device 14 suffers from the consumption of the toner due to the developing process in which the toner is supplied from the developing roll 141 to the electrostatic latent image formed on the circumferential surface of the photoconductor drum 11 to electrostatically attach the toner to the electrostatic latent image. The toner concentration of the developer 4 accommodated in the device housing 140 is detected by the toner concentration sensor 170 disposed on the downstream side in the transport direction of the developer 4 of the stirring and transport member 143.

When it is determined that the toner concentration of the developer 4 in the device housing 140 detected by the toner concentration sensor 170 becomes less than a required threshold value, the controller 100 supplies the toner from the toner cartridge 145 through the transport member 159 into the device housing 140. As illustrated in FIG. 5, the toner supplied into the device housing 140 is stirred together with the developer 4 accommodated in the device housing 140 while being transported by the stirring and transport member 143.

In this exemplary embodiment, since the gap holding members 175 are installed on the stirring and transport member 143, the gap between the detecting unit 172 of the toner concentration sensor 170 and the stirring members 173 of the stirring and transport member 143 is always maintained at a required value.

Figure 13:
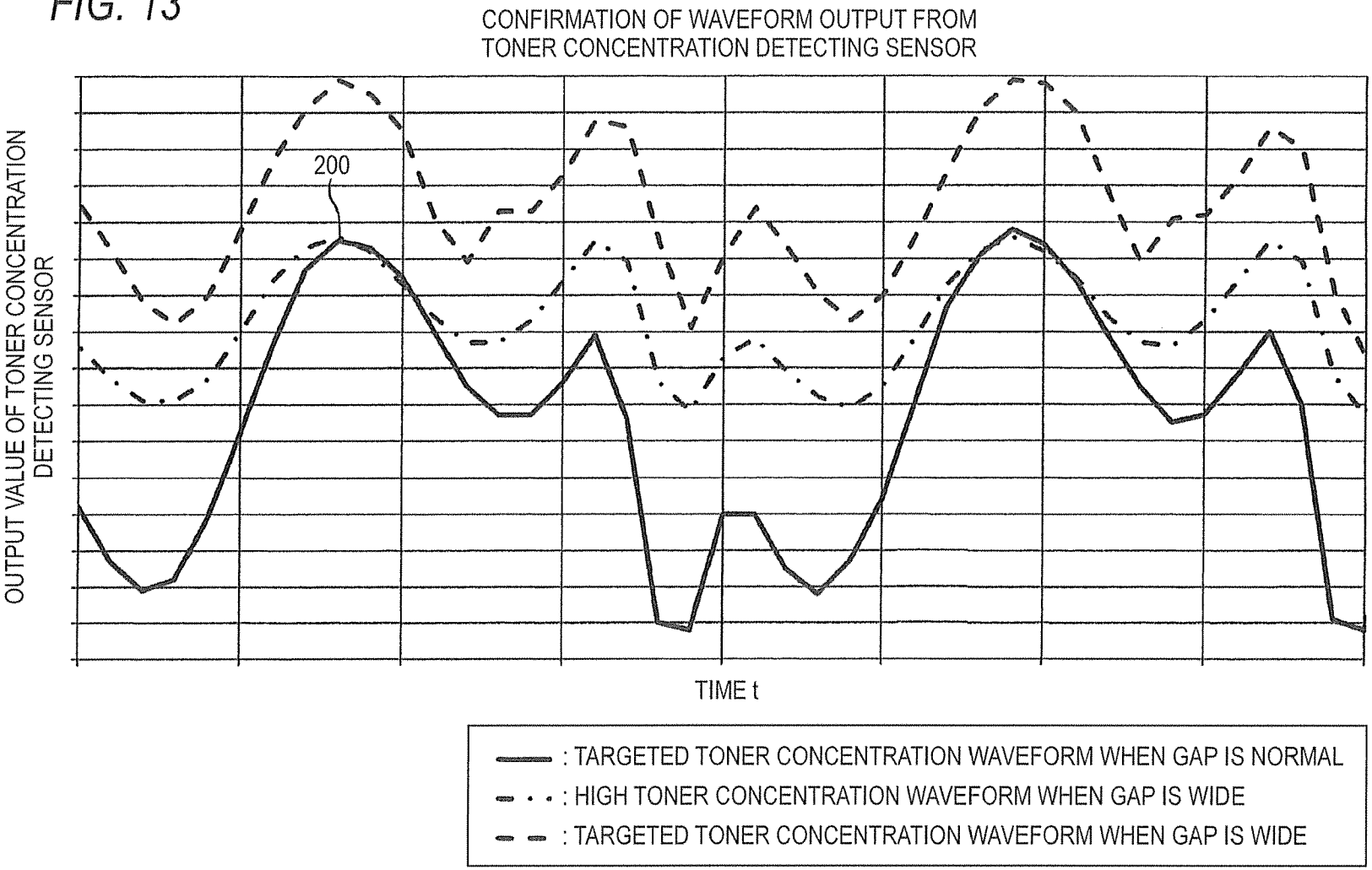
FIG. 13 is a graph illustrating an output waveform of the toner concentration sensor.

Therefore, a signal as illustrated in FIG. 13 is output from the toner concentration sensor 170 depending on the toner concentration of the developer 4 in the device housing 140.

In FIG. 13, a solid line illustrates an output waveform of the toner concentration sensor 170 when the stirring and transport member 143 of the exemplary embodiment has the gap holding members 175. In the case where the stirring and transport member 143 of the exemplary embodiment has the gap holding members 175, it has been found that the output waveform of the toner concentration sensor 170 becomes the lowest value, and a peak 200 of the output waveform of the toner concentration sensor 170 corresponds to the toner concentration of the developer 4 in the device housing 140 so that the toner concentration of the developer 4 may be precisely detected.

In contrast, in FIG. 13, a broken chain line illustrates an output waveform of the toner concentration sensor 170 when the stirring and transport member 143 does not have the gap holding members 175 and the gap between the toner concentration sensor 170 and the stirring members 173 of the stirring and transport member 143 is wider than the normal value.

Further, in FIG. 13, a one-dot chain line illustrates an output waveform of the toner concentration sensor 170 when the stirring and transport member 143 does not have the gap holding members 175, the gap between the toner concentration sensor 170 and the stirring member 173 of the stirring and transport member 143 is wider than the normal value, and the toner concentration of the developer 4 in the device housing 140 is higher than a targeted toner concentration.

When the stirring and transport member 143 of the exemplary embodiment has the gap holding members 175 as described above, it has been found that the toner concentration of the developer 4 in the device housing 140 may be precisely detected.

In contrast, when the stirring and transport member 143 does not have the gap holding members 175 and the gap between the toner concentration sensor 170 and the stirring member 173 of the stirring and transport member 143 is wider than the normal value, it has been found that the output waveform of the toner concentration sensor 170 exhibits a relatively large value, compared to a proper case, and thus, the toner concentration of the developer 4 in the device housing 140 is erroneously detected as a value that is lower than an actual value.

Therefore, the exemplary embodiment attaches the magnetic member to the stirring and transport member so as to constitute a gap detecting unit for detecting the gap between a detecting surface of the toner concentration detecting unit and the stirring and transport member, which improves the detecting precision of the toner concentration without using the magnetic member, compared to the case of suppressing the detection error in toner concentration which is caused by a variation in the gap between the detected surface of the toner concentration detecting unit and the stirring and transport member.

In the foregoing exemplary embodiment, descriptions have been made with reference to the case of forming a monochrome image with the image forming apparatus. However, the descriptions may also be applied to an image forming apparatus that has plural imaging devices that forms a full color image.

Further, in the foregoing exemplary embodiment, descriptions have been made with reference to the case of installing two gap holding members at the positions different by 180 degrees on the outer circumference of the stirring and transport member, respectively. However, three or more gap folding members may be disposed on the outer circumference of the stirring and transport member. For example, three gap holding members may be installed, respectively, at positions different by, for example, 120 degrees.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developing container that accommodates a two-component developer;

a toner concentration detecting unit that detects a toner concentration of the developer which is formed of a non-magnetic toner and a magnetic carrier by detecting a permeability of the developer by a detecting unit exposed to an inner wall of the developing container;

a transport member that is disposed within the developing container and stirs and transports the developer with a transport blade having a pitch that is equal to or less than a size of the detecting unit of the toner concentration detecting unit; and a plurality of gap holding members provided at a position facing the toner concentration detecting unit of the transport member and holding a gap such that a tip thereof is abutted against the inner wall of the developing container, wherein each of the gap holding members is installed on a columnar rotating shaft of the transport member and outward in a radial direction of the columnar rotating shaft, and the gap holding members are disposed such that the gap holding members overlap the toner concentration detecting unit when the gap holding members and the toner concentration detecting unit are viewed from an axis direction of the columnar rotating shaft.

2. The developing device according to claim 1, wherein the transport member has a flat plate-shaped stirring member facing the detecting unit of the toner concentration detecting unit via the gap, and the plurality of gap holding members are integrally provided with the stirring member.

3. The developing device according to claim 1, further comprising:

a screen member that comprises a plurality of slits which have a gap set to be smaller than foreign matter entrained in the developer; and a cleaning member that is provided at the transport member and cleans the foreign matter that is not pass through the screen member, wherein the gap holding members are provided, respectively, in a same direction as, and in an opposite direction, to the cleaning member in a peripheral direction of the transport member.

4. The developing device according to claim 2, further comprising:

a screen member that comprises a plurality of slits which have a gap set to be smaller than foreign matter entrained in the developer; and a cleaning member that is provided at the transport member and cleans the foreign matter that is not pass through the screen member, wherein the gap holding members are provided, respectively, in a same direction as, and in an opposite direction, to the cleaning member in a peripheral direction of the transport member.

5. An image forming apparatus comprising:

an image holding member that holds an electrostatic latent image; and a developing unit that develops the electrostatic latent image on the image holding member, wherein the developing unit is the developing device according to claim 1.

6. An image forming apparatus comprising:

an image holding member that holds an electrostatic latent image;

a developing unit that develops the electrostatic latent image on the image holding member;

a transfer unit that transfers an image developed on the image holding member to a recording medium;

a cleaning unit that removes a developer remaining on the image holding member; and a reuse unit that transports, to the developing unit, the developer removed by the cleaning unit to use the developer for developing again, wherein the developing unit is the developing device according to claim 1.

7. The developing device according to claim 1, wherein the tip of each of the gap holding members protrudes outwardly relative to the transport member.

8. The developing device according to claim 1, wherein each of the gap holding members is formed in a prism shape.

9. The developing device according to claim 1, wherein the tip of each of the gap holding members is closer to the inner wall of the developing container than a surface of the toner concentration detecting unit that protrudes inwardly from the inner wall of the developing container.

10. The developing device according to claim 1, wherein the gap holding members are in contact with the inner wall of the developing container over an entire circumference of the transport member.

11. The developing device according to claim 1, wherein the gap holding members comprises a first gap holding member and a second gap holding member, and the first gap holding member and the second gap holding member are disposed at positions that differ by 180 degrees.

* * * * *